US005153394A

United States Patent [19]

Abendroth et al.

[11] Patent Number: 5,153,394

[45] Date of Patent: Oct. 6, 1992

[54] TILT-ACTUATED SWITCH

[75] Inventors: Manfred Abendroth, Marbach; Joachim Gillert, Berlin; Herbert Keller, Wiernsheim, all of Fed. Rep. of Germany

[73] Assignee: Robert Bosch GmbH, Stuttgart, Fed. Rep. of Germany

[21] Appl. No.: 724,142

[22] Filed: Jul. 1, 1991

[30] Foreign Application Priority Data

Jun. 29, 1990 [DE] Fed. Rep. of Germany ..... 4021056

[51] Int. Cl.[5] ..... H01H 35/02

[52] U.S. Cl. ..... 200/61.52; 200/61.45 R

[58] Field of Search ..... 200/61.52, 61.45 R, 200/61.51; 340/429, 440, 689

[56] References Cited

U.S. PATENT DOCUMENTS 2,064,827 12/1936 Gardner ..... 200/61.51
2,099,483 11/1937 Hinde ..... 200/61.52
4,124,841 11/1978 Kettunen ..... 200/61.52

FOREIGN PATENT DOCUMENTS 730071 8/1932 France ..... 200/61.52

*Primary Examiner*—Harold Broome
*Attorney, Agent, or Firm*—Frishauf, Holtz, Goodman & Woodward

[57] ABSTRACT

A tilt-actuated switch features a housing 11 and a contact element 14 movable within the housing between a stable first position and a second position in which the contact element electrically connects two fixed contact elements secured to the housing. The movable contact element responds to tilting of said housing beyond a predetermined critical angle, with respect to the vertical, by flipping from the stable first position through an unstable position (FIG. 2) into a second position (FIG. 3) which is stable. Unlike prior art tilt-actuated switches, this improved switch applies sufficient force against the fixed contacts, even when the tilting is gradual, to assure reliable electrical contact, necessary for applications such as a "dead-man-switch" in a portable radio transceiver.

9 Claims, 2 Drawing Sheets

TILT-ACTUATED SWITCH

Cross-references to related applications, assigned to the assignee of the present application, the disclosures of which are hereby incorporated by reference:

U.S. Ser. No. 07/701,781, BANTIEN, filed May 17, 1991, based on German Application P 40 16 471.3 of May 22, 1990;

U.S. Ser. No. 07/701,880, BANTIEN & FINDLER, filed May 17, 1991, based on German Application P 40 16 472.1 of May 22, 1990;

U.S. Ser. No. 07/701,210, KIPPELT et al., filed May 16, 1991, based on German Application P 40 16 032.7 of May 18, 1990.

FIELD OF THE INVENTION

The present invention relates generally to tilt switches having a movable contact element which bridges two other fixed contacts and, more particularly, to a solid movable contact element which flips decisively when tilted beyond a predetermined angle.

BACKGROUND

There is a known tilt switch, in which the movable contact element, upon tilting of the switch housing beyond a predetermined angle, moves from a stable first position into another position in which it bridges two fixed contact elements. However, this known tilt switch has the defect that, when the tilt angle increases only slowly, the movable contact element is applied to the fixed contact elements with minimal contact force, so that reliable and continuously electrical contact cannot be assured. Such reliable contact is highly desirable in tilt switches for applications such as a "dead-man switch" used for a mobile radio transceiver carried in the hand or on one's person. In this application, it is necessary to consistently achieve a reliable electrical contact and, connected therewith, reliable generation of an alarm signal.

SUMMARY OF THE INVENTION

Accordingly, it is a primary object of the present invention to improve the known tilt switch, so that passage of a predetermined critical angle leads to a reliable electrical contact with sufficient contact force.

Briefly, this object is achieved by so shaping and dimensioning the movable contact, and the chamber within which it is received, that passage through the critical angle causes the movable contact to flip from a stable first position through an unstable intermediate position into a stable second position where good contact is assured.

This has the advantage that, as soon as the movable element passes through the unstable intermediate position or range of positions, it lands in the second stable position in which substantial contact force is present to assure the electrical connection between the fixed contact elements, thus closing the switch. A preferred application for this tilt switch is a mobile radio transceiver, adapted to be carried in the hand or on one's person, for example by a guard or an industrial plant operator.

BRIEF FIGURE DESCRIPTION

DETAILED DESCRIPTION OF THE PREFERRED EMBODIMENTS

Figure 1:
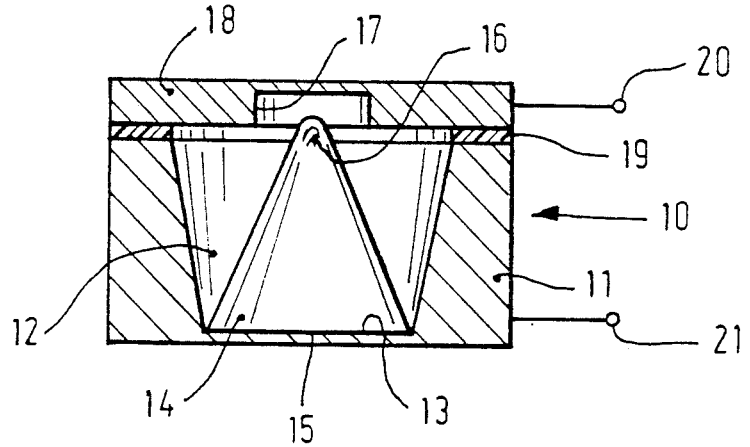
FIG. 1 is a cross-sectional view of a first embodiment of the tilt switch of the present invention, in a first stable (switch open) position.
Figure 2:
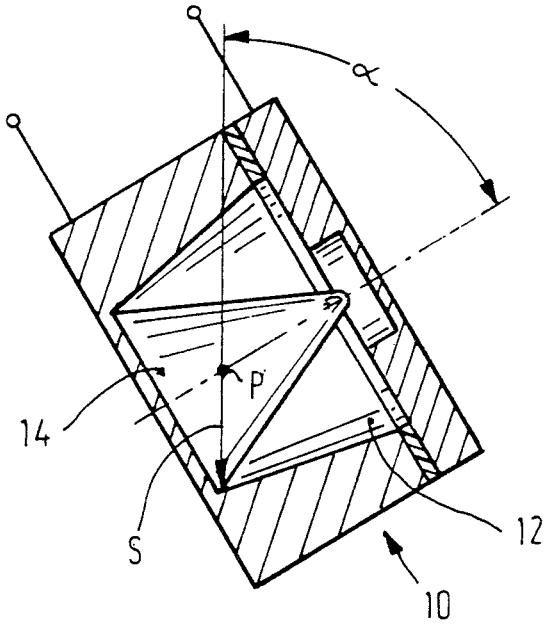
FIG. 2 is a cross-sectional view thereof, in an intermediate unstable position.
Figure 3:
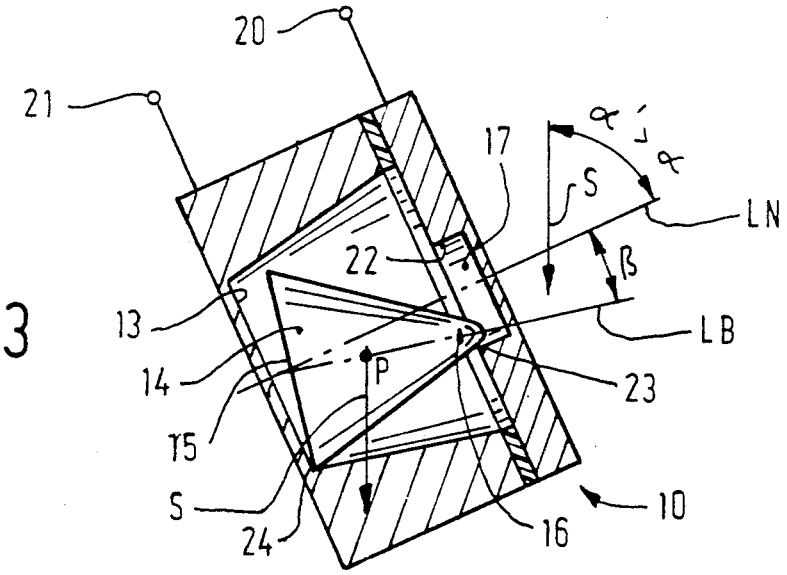
FIG. 3 is a cross-sectional view thereof, in a second, stable, electrical-contact-forming (switch closed) position.

FIGS. 1-3 illustrate a tilt switch 10 having a housing 11, preferably cylindrical, of electrically conductive material. Housing 11 is formed with an interior chamber 12 of frusto-conical configuration, tapering in toward the bottom. Chamber 12 has a floor 13, on which there rests a base surface 15 of a conical contact element 14. The cone has a point 16, preferably rounded off, which extends, with play, into a central recess 17 of a plate 18 of electrically conductive material. Plate 18 and housing 11 form, respectively, a first and a second stationary contact element. The contact elements are electrically separated by an annular insulating layer or ring 19. Plate 18 and housing 11 each have their own respective electrical terminal 20,21.

OPERATION

In the rest position (FIG. 1) of the tilt switch, in which its longitudinal axis is vertically oriented, the switch is open because the movable contact element 14 is in its first stable position, and conical point 16 does not make contact with plate 18. If, as shown in FIG. 2, tilt switch 10 is rotated by an angle alpha with respect to the axis of symmetry S passing through center of gravity P, the pivot edge or point of the movable contact 14 migrates down around the lower corner of this contact element and across the lower edge of interior chamber 12. The movable element assumes an unstable position. If the tilt switch is then tilted slightly more, see angle alpha prime in FIG. 3, then the movable contact element flips through a hysteresis angle beta (FIG. 3) into its second stable position.

The hysteresis angle beta is the angle between the longitudinal symmetry axis LN of tilt switch 10 and the longitudinal symmetry axis LB of movable element 14. Due to the flipping of movable element 14, its conical point 16 strikes or presses with sufficient contact force against rim or edge 22 of recess 17.

The value of hysteresis angle beta determines the distribution of gravitational force of movable element 14 on two contact positions 23 and 24. The greater the hysteresis angle beta chosen, the greater the contact forces applied to contact position 23 become. The distribution of gravitational force of the movable contact element between the two contact positions is thus improved in the region adjacent to tilt angle alpha, to the benefit of contact position 23.

Due to the hysteresis phenomenon, the movable contact element 14 will fall back into its first stable position (FIG. 1) upon tilting by less than the tilting necessary to flip the movable contact element from the first stable position into the second stable position.

Angle alpha depends upon the dimensions of base surface 15 and the location of center of mass P of movable contact element 14.

Figure 4:
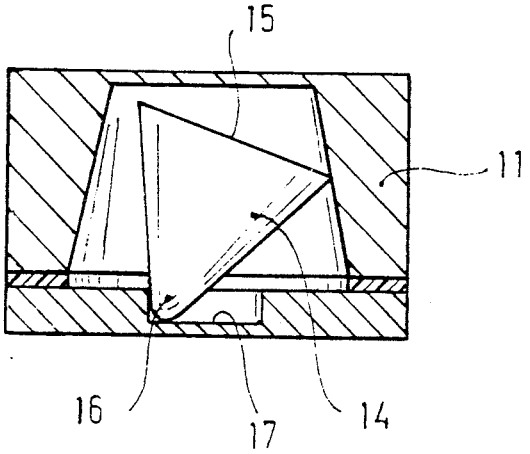
FIG. 4 is a cross-sectional view thereof, rotated 180° with respect to said first stable position.

In order for the contact element 14 of tilt switch 14 to also flip in a 180° rotated orientation and to make contact, the base surface is to be kept small relative to the base surface of contact element 14; compare conical point 16 in FIG. 4.

Figure 5:
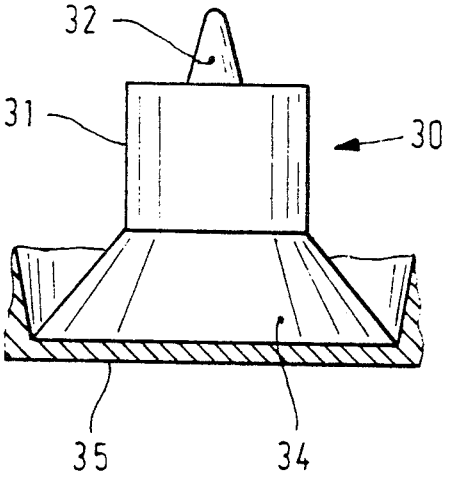
FIG. 5 illustrates a second embodiment of the movable contact element.

FIG. 5 illustrates an alternate embodiment, in which a movable contact element 30 has a cylindrical portion 31 from which a conical portion 32 extends upwardly and from which a downwardly broadening frusto-conical portion 34 extends downwardly.

The relatively large base surface 35 of the frustrum keeps the movable element 30 from flipping until a relatively large tilt angle alpha is reached. Due to the changed shape of movable contact element 30, it has a greater mass than that of the examples in FIGS. 1–4.

Various changes and modifications are possible within the scope of the inventive concept.

We claim:

1. A tilt switch having a housing (11);

a contact element (14), having a base surface (15) with a peripheral edge, movable within said housing between a stable first position and a second position in which said contact element electrically connects two fixed contact elements (11, 18) secured to said housing (10);

said movable contact element (14) responding to tilting of said housing beyond a first predetermined angle from vertical by flipping about said peripheral edge from said stable first position through an unstable position into said second position, said second position being stable, and responding to tilting or rotation of said housing, through a second predetermined angle, back toward its initial orientation, by falling back to said stable first position of said movable contact element, thereby electrically disconnecting said two fixed contact elements (11, 18) from each other.

2. Tilt switch according to claim 1, wherein said movable contact element (14) is a rotationally symmetrical body; and said body has a center of gravity (P) so located, with respect to said base surface (15), that, upon tilting of said housing beyond said first predetermined angle, said body flips along a periphery of said base surface.

3. Tilt switch according to claim 1, wherein said movable contact element (14) has an essentially conical shape.

4. Tilt switch according to claim 3, wherein said conical movable contact element (14) has a rounded-off conical point (16).

5. Tilt switch according to claim 1, wherein said housing (11) is generally cylindrical and is formed with an upwardly widening frusto-conical interior chamber (12) which receives said movable contact element (14).

6. Tilt switch according to claim 1, wherein said housing (10) of said switch itself serves as a first one (11) of said fixed contact elements, a plate (18) atop said housing serves as a second one of said fixed contact elements, and an annular insulating layer (19) electrically separates said first and second fixed contact elements (10, 18).

7. Tilt switch according to claim 6, wherein said movable contact element (14) has an essentially conical shape with a rounded-off conical point (16), and said plate (18) is formed with a central recess (17), into which said point (16) of said movable contact element extends, said point (16) and recess (17) being so dimensioned as to allow play therebetween.

8. Tilt switch according to claim 1, wherein said movable contact element (30) has a cylindrical portion (31) from which a conical portion (32) upwardly extends, and from which a downwardly widening frusto-conical portion (34) downwardly extends.

9. Tilt switch according to claim 1, wherein said movable contact element (14) is a rotationally symmetrical body with a longitudinal axis (LB) and flips to close an electrical connection between said two fixed contact elements (11, 18) in response to rotation in any direction by said first predetermined angle (alpha) away from an initial vertical orientation, and flips back to break said electrical connection between said two fixed contact elements (11, 18) in response to rotation back by said second predetermined angle (beta), said second predetermined angle being smaller than said first predetermined angle.

* * * * *